US009638208B2

(12) United States Patent
Tomita et al.

(10) Patent No.: US 9,638,208 B2
(45) Date of Patent: May 2, 2017

(54) CENTRIFUGAL COMPRESSOR

(75) Inventors: Isao Tomita, Tokyo (JP); Toru Hoshi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 494 days.

(21) Appl. No.: 13/879,301

(22) PCT Filed: Dec. 6, 2011

(86) PCT No.: PCT/JP2011/078201

§ 371 (c)(1),
(2), (4) Date: Apr. 12, 2013

(87) PCT Pub. No.: WO2012/090657

PCT Pub. Date: Jul. 5, 2012

(65) Prior Publication Data

US 2013/0266450 A1 Oct. 10, 2013

(30) Foreign Application Priority Data

Dec. 28, 2010 (JP) ..... 2010-294078

(51) Int. Cl.
*B63H 7/02* (2006.01)
*B64C 11/16* (2006.01)
(Continued)

(52) U.S. Cl.
CPC ..... *F04D 29/284* (2013.01); *F04D 29/30* (2013.01); *F04D 29/666* (2013.01)

(58) Field of Classification Search
CPC ..... F04D 29/24; F04D 29/242; F04D 29/28; F04D 29/284; F04D 29/30
(Continued)

(56) References Cited

U.S. PATENT DOCUMENTS 3,069,072 A 12/1962 Birmann
4,543,041 A * 9/1985 French ..... F04D 29/30 416/183
(Continued)

FOREIGN PATENT DOCUMENTS

CN 1302356 A 7/2001
JP 2-37297 U 3/1990
(Continued)

OTHER PUBLICATIONS

Machine translation EP0205001 to Sigmunn by Espacenet 2015.*
(Continued)

*Primary Examiner* — Deming Wan
(74) *Attorney, Agent, or Firm* — Birch, Stewart, Kolasch & Birch, LLP

(57) ABSTRACT

Provided is a centrifugal compressor including a first splitter blade 7 arranged nearer to a suction side Sb of a full blade 5F located upstream in a rotating direction of the compressor, and a second splitter blade 8 provided farther from the suction side Sb of the full blade 5F and being shorter than the first splitter blade 7. Leading edges 7*a* and 8*a* on the shroud side of the first splitter blade 7 and the second splitter blade 8 are offset from positions dividing the space between the full blades at equal intervals by the number of splitter blades therebetween toward the suction side Sb of the full blade.

7 Claims, 8 Drawing Sheets

(51) Int. Cl.

| | |
|---|---|
| ***B64C 27/46*** | (2006.01) |
| ***F01D 5/14*** | (2006.01) |
| ***F04D 29/38*** | (2006.01) |
| ***F04D 29/28*** | (2006.01) |
| ***F04D 29/30*** | (2006.01) |
| ***F04D 29/66*** | (2006.01) |

(58) Field of Classification Search
USPC ..... 416/223 B, 223 R
See application file for complete search history.

(56) References Cited

U.S. PATENT DOCUMENTS

| | | | | |
|---|---|---|---|---|
| 5,213,473 | A * | 5/1993 | Fiala | F01D 5/048 416/183 |
| 6,508,626 | B1 * | 1/2003 | Sakurai | F04D 29/284 416/180 |
| 2004/0005220 | A1 | 1/2004 | Kawamoto et al. | |
| 2010/0254816 | A1 * | 10/2010 | Dettmann | F04D 29/30 416/223 A |

FOREIGN PATENT DOCUMENTS

| | | | | |
|---|---|---|---|---|
| JP | 10-213094 | A | 8/1998 | |
| JP | 2002-516960 | A | 6/2002 | |
| JP | 2002-332992 | A | 11/2002 | |
| JP | 2002-349488 | A | 12/2002 | |
| JP | 2005-180372 | A | 7/2005 | |
| JP | 3876195 | B2 | 1/2007 | |
| JP | 2009-228549 | A | 10/2009 | |
| NO | EP 0205001 | A1 * | 12/1986 | F04D 29/284 |
| WO | WO 99/61800 | A1 | 12/1999 | |
| WO | WO 2005/054681 | A1 | 6/2005 | |

OTHER PUBLICATIONS

Decision to Grant a Patent effective Nov. 10, 2014 issued in corresponding Japanese Application No. 2010-294078 with an English Translation.
International Preliminary Report on Patentability mailed on Jul. 18, 2013 issued in PCT/JP2011/078201 with an English translation.
Chinese Office Action effective Mar. 2, 2015 issued in corresponding Chinese Application No. 201180048877.2 with an English Translation.
Chinese Notice of Allowance, dated Mar. 17, 2016, for Chinese Application No. 201180048877.2 with English translation thereof.

* cited by examiner

SHROUD SIDE
HUB SIDE
FRONT EDGE SHAPE
REAR EDGE SHAPE
CIRCUMFERENTIAL POSITION ON THE SHROUD SIDE
CIRCUMFERENTIAL POSITION ON THE HUB SIDE
L
0.1L~0.3L
ΔP
Δθ1
Δθ2
β1
β2
5a
5b
5R
5F
7
7a
7b
8
8a
8b
9
11
12
13
Sa
Sb
Z1
Z2

SHROUD SIDE
HUB SIDE
FRONT EDGE SHAPE
REAR EDGE SHAPE
CIRCUMFERENTIAL POSITION ON THE SHROUD SIDE
CIRCUMFERENTIAL POSITION ON THE HUB SIDE
0.1L~0.3L
L
ΔP
5a
5b
5F
5R
7
7a
7b
8
8a
8b
9
11
12
13
Sa
Sb
S

CENTRIFUGAL COMPRESSOR

TECHNICAL FIELD

The present invention relates to a centrifugal compressor used in a turbocharger or the like of vehicles or ships, and more particularly to a centrifugal compressor having two or more splitter blades provided between full blades adjoining each other.

BACKGROUND ART

Centrifugal compressors used in a compressor part or the like of turbochargers in vehicles or ships give a kinetic energy to a fluid through rotation of a vaned wheel and discharge the fluid radially outward by the centrifugal force to raise the fluid pressure. In response to the demands for a high-pressure ratio and high efficiency in a wide operation range of such centrifugal compressors, impellers (vaned wheels) 05 having splitter blades 03 each arranged between full blades 01 adjoining each other as shown in FIG. 9 and FIG. 10 are commonly used.

Such impeller 05 with splitter blades 03 includes the full blades 01 and the splitter blades 03 arranged alternately on the surface of a hub 07. Common splitter blades 03 have the same shape as the full blades 01 with their upstream sides simply cut off.

The inlet edge (LE2) of the commonly known splitter blade 03 is located a preset distance downstream of the inlet edge (LE1) of the full blade 01 as shown in FIG. 11, while the trailing edges (TE) are placed at the same position. The blade angle θ at the inlet edge of the splitter blade 03 (indicated as an angle made between the direction of the inlet edge and the axial direction G of the impeller 05) is set the same as that of the flow direction F of the fluid flowing through the flow passage between the full blades 01.

Meanwhile, techniques of making the throat areas of two passages formed on both sides of each splitter blade 03 equal so as to distribute the fluid evenly have been known. Patent Document 1 (Japanese Patent Application Laid-open No. H10-213094), for example, discloses a technique in which, as shown in FIG. 12, the blade angle θ at the inlet edge of the splitter blade 09 is set larger to be θ+Δθ, (the angle is set larger by Δθ relative to the flow direction F of the fluid), i.e., the splitter blade is positioned closer to the suction side Sb of the full blade 01, in order to make the throat areas of the passages on both sides of the splitter blade 09 equal (A1=A2).

The positioning of the inlet end of the splitter blade inclined to the suction side of the full blade is also known from the disclosure in Patent Document 2 (Japanese Patent Publication No. 3876195).

Patent Document 1: Japanese Patent Application Laid-open No. H10-213094

Patent Document 2: Japanese Patent Publication No. 3876195

The techniques shown in Patent Documents 1 and 2 both relate to an improvement in the blade shape in respect of flow rate distribution in flow passages divided by the splitter blade based on an assumption that the fluid between the blades flows along the full blades. In open type impellers with a tip clearance, the flow field is complex due to the tip leakage flow coming into or out of the passage through the tip clearance, because of which a further improvement was needed to the blade shape to better adapt to such complex internal flow.

An evaluation of such complex internal flow through a numerical analysis revealed that the tip leakage vortex (vortex flow leaking at the blade tip as shown in FIG. 8, hereinafter referred to as "tip leakage vortex W") generated from the tip of the inlet edge of the full blade (the distal end of the blade (on the shroud side) in the direction of height from the hub surface) reached the vicinity of the tip of the inlet edge of the splitter blade (the distal end of the blade (on the shroud side) in the direction of height from the hub surface).

In view of this, the present inventors filed a patent application (Japanese Patent Application No. 2009-233183, not published yet) relating to a technique of preventing the tip leakage vortex W from interfering with the splitter blade by inclining the leading edge of the splitter blade toward the suction side of the full blade.

To accomplish an even higher pressure ratio and efficiency, and a wider range of operation of the centrifugal compressor, it is essential to increase the number of blades. Providing two or more splitter blades is therefore a significant technique, but Patent Documents 1 and 2, or the previous application mentioned above, do not disclose any specific improvements in regard to a plurality of splitter blades.

DISCLOSURE OF THE INVENTION

Accordingly, the present invention was made in view of these problems. An object of the invention is to provide a centrifugal compressor having two or more splitter blades between full blades, which can achieve a higher pressure ratio and improved efficiency by preventing the tip leakage vortex of the full blades and splitter blades from interfering with the plurality of splitter blades located downstream in the rotating direction.

To solve the problems described above, the present invention provides a centrifugal compressor including a plurality of full blades that stand equally spaced in a circumferential direction and extend from a fluid inlet part to a fluid outlet part on a surface of a hub; and two or more splitter blades each provided to extend from a point in a flow passage formed between the full blades arranged adjacent to each other, to the outlet part. The compressor further includes a first splitter blade provided on a side nearer to a suction side of a full blade located upstream in a rotating direction of the compressor and having a length in a flow passage direction shorter than that of the upstream side full blade, and a second splitter blade provided on a flow-pressure side of the first splitter blade and having a length in the flow passage direction shorter than that of the first splitter blade. Leading edge portions on a shroud side of the first splitter blade and the second splitter blade are offset from positions dividing a space between the full blades at equal intervals by the number of impellers therebetween toward the suction side of the full blade.

With this invention, in the centrifugal compressor wherein a tip clearance is present between tips of the full blades and a shroud, leading edge portions on a shroud side of the first splitter blades are offset from positions dividing the space between the full blades at equal intervals by the number of impellers therebetween toward the suction side of the full blade, so that a tip leakage vortex flowing from the tip clearance toward the leading edge portions of the splitter blades will flow over the leading edge portions of the splitter blades, or so that the leading edge portions will conform to a direction of the tip leakage vortex, whereby the tip leakage vortex is prevented from interfering with the leading edge portions of the first splitter blades.

Moreover, the leading edge portions on the shroud side of the second splitter blades, which are provided on the suction side of the first splitter blade and having a length in the flow passage direction shorter than the first splitter blade, are also offset from positions dividing the space between the full blades at equal intervals by the number of impellers therebetween toward the suction side of the full blade, so that the tip leakage vortex flowing from the tip clearance between the tips of the first splitter blades and the shroud toward the leading edge portions of the second splitter blades is also prevented from interfering with the leading edge portions of the second splitter blades.

As the tip leakage vortex is prevented from interfering with both of the first splitter blades and the second splitter blades, the efficiency and performance of the centrifugal compressor having a plurality of splitter blades can be improved.

In the present invention, preferably, an offset amount of the second splitter blade toward the suction side of the full blade may be larger than an offset amount of the first splitter blade toward the suction side of the full blade.

The tip leakage vortex that flows toward the leading edge portions on the shroud side of the second splitter blades is generated at the leading edges of the first splitter blades, and therefore the leading edge portions of the second splitter blades need to be offset more than the leading edge portions of the first splitter blades.

Moreover, since the tip leakage vortex that flows toward the leading edge portions of the second splitter blades contains both the tip leakage vortex formed by the full blades and the tip leakage vortex formed by the first splitter blades, the second splitter blades need to be offset toward the suction side of the full blade in a larger amount than the first splitter blades so as to effectively avoid the tip leakage vortex. Thereby the leakage vortex can be veered away more reliably.

In the present invention, preferably, the respective trailing edge portions on the hub side of the first splitter blade and the second splitter blade may be offset from the circumferentially equally spaced positions between the full blades toward the suction side of the full blade.

As the respective trailing edge portions on the hub side of the first and second splitter blades are offset from the circumferentially equally spaced positions between the full blades toward the suction side of the full blade, the blade curvature (blade load) is increased on the hub side, whereby the pressure ratio of the compressor as a whole can be improved.

In improving the pressure ratio, since the leading edge portions on the shroud side are already offset toward the suction side of the full blade for avoidance of the tip leakage vortex to have a larger blade curvature (higher blade load), there is a risk that separation may occur there. Therefore, the trailing edge portions on the hub side are offset from the circumferentially equally spaced positions between the full blades toward the suction side of the full blade to achieve an even balance of blade load between the hub side and the shroud side of the splitter blades.

Therefore, the risk of separation or the like is reduced by lowering the load on the shroud side, while an even balance is achieved between the hub side and the shroud side of the splitter blades by the increase in load on the hub side, whereby the overall performance and durability of the compressor can be improved.

Further, in the present invention, preferably, the respective trailing edge portions on the shroud side of the first splitter blade and the second splitter blade may be offset from the circumferentially equally spaced positions between the full blades toward a pressure side of the full blade.

The blade load on the shroud side can be reduced by offsetting the trailing edge portions on the shroud side of the splitter blades toward the pressure side of the full blade.

That is, the leading edge portions on the shroud side are subjected to a large blade load as they are offset toward the suction side of the full blade for avoidance of interference with the tip leakage vortex as mentioned above. The trailing edge portions on the hub side are offset from the circumferentially equally spaced positions between the full blades toward the suction side of the full blade to achieve an even balance of blade load. However, there may still be the risk of separation or the like occurring on the shroud side if the increased blade load on the shroud side is not sufficiently counterbalanced. In such a case, the load on the shroud side can be further reduced by offsetting the trailing edge portions on the shroud side from the circumferentially equally spaced positions between the full blades toward the pressure side of the full blade.

As a result, the risk of separation or the like is reduced by lowering the load on the shroud side as described above, while an even balance of blade load is achieved between the hub side and the shroud side of the splitter blades by the increase in load on the hub side, whereby the overall performance and durability of the compressor can be improved.

In the present invention, preferably, the compressor may further include a third splitter blade provided on a suction side of the second splitter blade and having a length in the flow passage direction shorter than that of the second splitter blade, and a leading edge portion on the shroud side of the third splitter blade may be offset from one of the positions dividing the space between the full blades at equal intervals by the number of splitter blades therebetween toward the suction side of the full blade.

An offset amount of the third splitter blade toward the suction side of the full blade may be larger than an offset amount of the second splitter blade toward the suction side of the full blade.

The third splitter blades thus configured provide the same advantageous effects as those of the second splitter blades described above, and interference with the tip leakage vortex generated from the tips of the full blades, first splitter blades, and second splitter blades can be avoided.

According to the present invention, as the leading edge portions on the shroud side of second splitter blades, which are shorter than the first splitter blades, are also offset from positions dividing the space between the full blades at equal intervals by the number of impellers therebetween toward the suction side of the full blade, the tip leakage vortex flowing from the tip clearance between the tips of the first splitter blades and the shroud toward the leading edge portions of the second splitter blades is also prevented from interfering with the leading edge portions of the second splitter blades.

As a consequence of preventing the tip leakage vortex of the full blades and splitter blades from interfering with the plurality of splitter blades located downstream in the rotating direction, a higher pressure ratio and improved efficiency can be achieved in a centrifugal compressor having two or more splitter blades between the full blades.

BEST MODE FOR CARRYING OUT THE INVENTION

The illustrated embodiments of the present invention will be hereinafter described in detail.

It should be noted that, unless otherwise specified, the size, material, shape, and relative arrangement or the like of constituent components described in these embodiments are only illustrative examples and not intended to limit the scope of this invention.

(First Embodiment)

Figure 1:
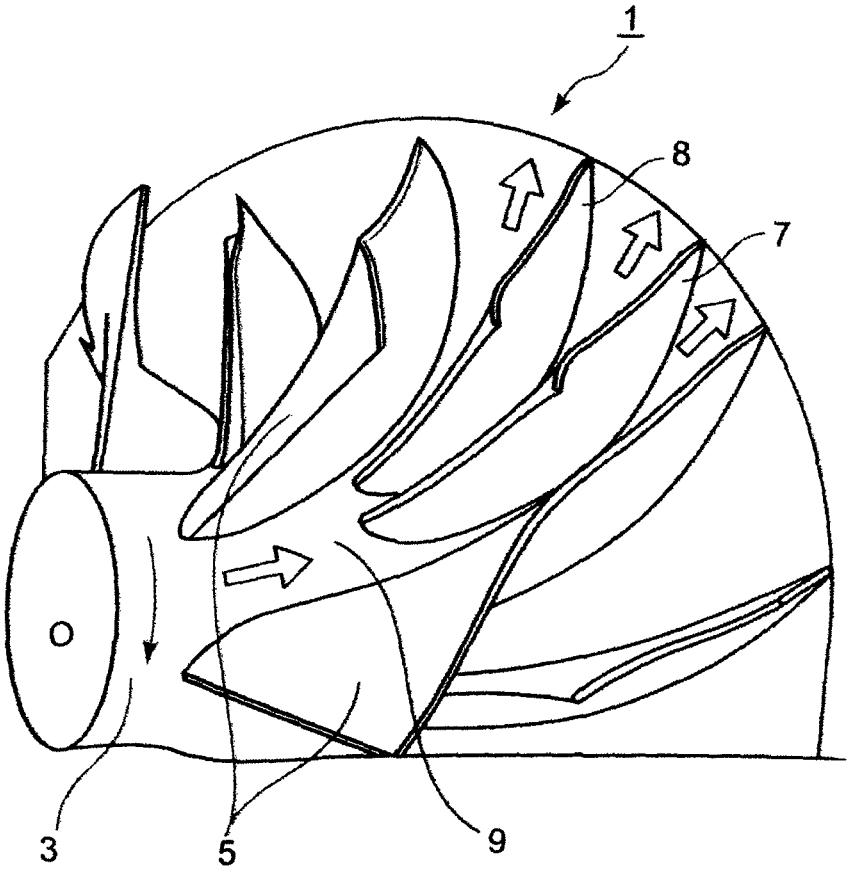
FIG. 1 is a perspective view illustrating essential parts of an impeller of a centrifugal compressor according to the present invention.

FIG. 1 is a perspective view illustrating essential parts of an impeller (vaned wheel) of a centrifugal compressor, to which the splitter blade of the present invention is applied. The impeller 1 includes a plurality of full blades 5 adjoining each other on an upper surface of a hub 3 fitted to a rotor shaft (not shown), and first splitter blades 7 and second splitter blades 8 provided in between the full blades 5 at circumferentially equal intervals ΔP (see FIG. 2).

The first splitter blades 7 and the second splitter blades 8 are shorter in the flow direction of fluid than the full blades 5, the second splitter blades 8 being shorter than the first splitter blades 7, and they extend from a point in a flow passage 9 formed between front and rear full blades 5 to an outlet part. The impeller 1 rotates in the direction of the arrow. The rotation center is denoted by O.

Figures 2A, 2B, 2C, 2D:
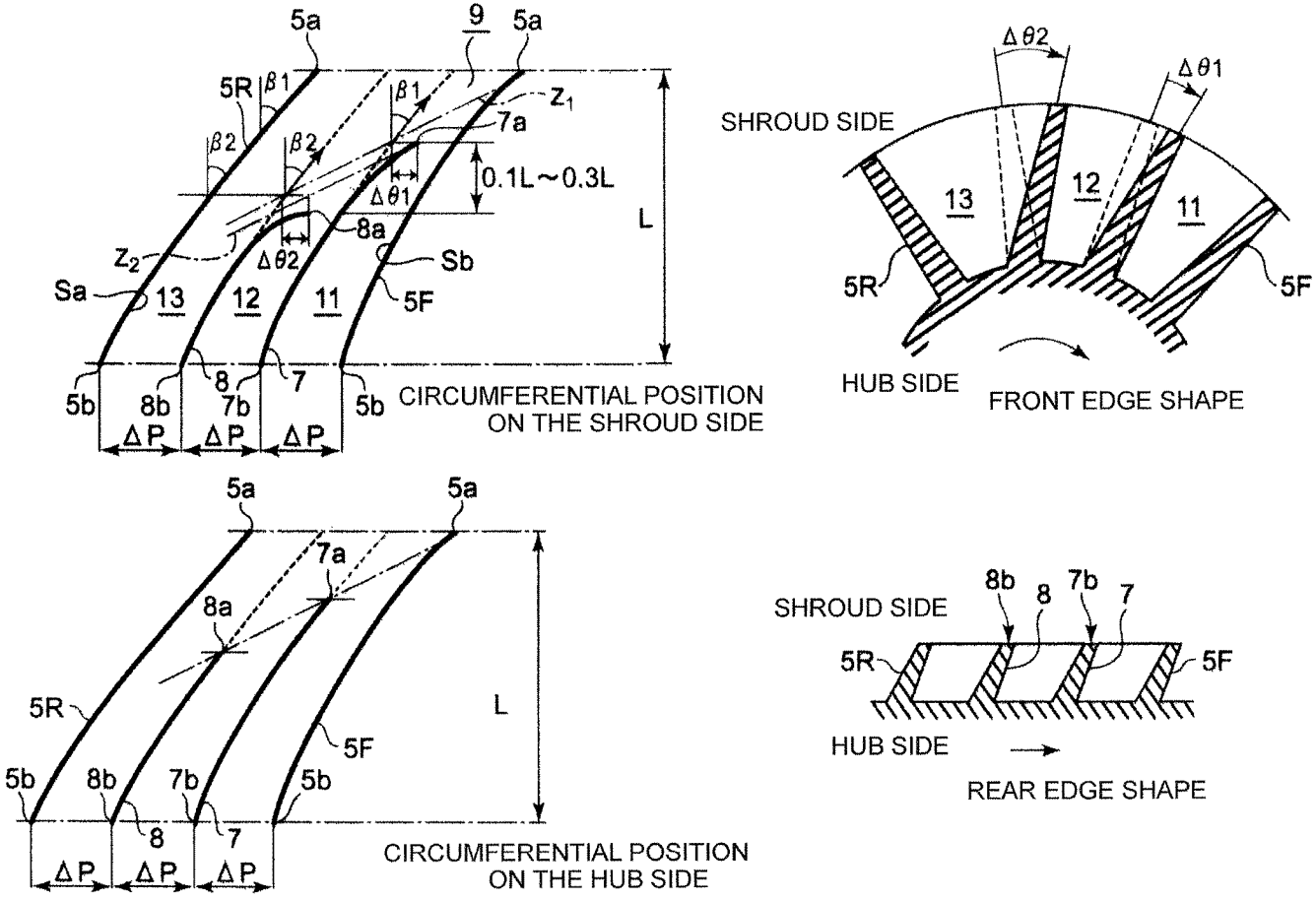
FIG. 2 is an explanatory diagram illustrating the relationship between full blades and splitter blades in a first embodiment, FIG. 2A showing the positional relationship on a shroud side in a circumferential direction, FIG. 2B showing the positional relationship on a hub side in the circumferential direction, FIG. 2C showing a front view of a leading edge shape relative to a flow direction, and FIG. 2D showing a front view of a trailing edge shape relative to the flow direction.

FIG. 2A shows the positional relationship between a first splitter blade 7, a second splitter blade 8, and full blades 5 on the shroud side, i.e., on the blade tip side.

The leading edge 7*a*, or the leading edge, of the first splitter blade 7 is located downstream in the flow direction of the leading edge 5*a*, or the leading edge, of the full blade 5. The leading edge 8*a*, or the leading edge, of the second splitter blade 8 is located downstream in the flow direction of the leading edge 7*a*, or the leading edge, of the first splitter blade 7. The trailing edge 7*b*, or the trailing edge, of the first splitter blade 7, the trailing edge 8*b*, or the trailing edge, of the second splitter blade 8, and the trailing edge 5*b*, or the trailing edge, of the full blade 5, are placed at the same position in the circumferential direction.

The first splitter blade 7 and the second splitter blade 8 are positioned such as to split the flow passage 9 formed between a pressure side Sa and a suction side Sb of full blades 5 in three equal parts in the circumferential direction, so that there are formed a flow passage 11 between the first splitter blade 7 and the wall surface on the suction side Sb of the full blade 5, a flow passage 12 between the first and second splitter blades 7 and 8, and a flow passage 13 between the second splitter blade 8 and the wall surface on the pressure side Sa of the full blade 5.

The first splitter blade 7 and the second splitter blade 8 are shaped to conform to the full blade 5, i.e., the inclination angle β1 of the leading edge 7*a* of the first splitter blade 7 is the same as that of the full blade 5, and the inclination angle β2 of the leading edge 8*a* of the second splitter blade 8 is the same as that of the full blade 5.

The impeller 1 thus configured is housed inside a shroud (not shown) that covers the full blades 5, the first splitter blades 7, and the second splitter blades 8, and configured as an open type impeller with a tip clearance between the shroud and these blades.

Accordingly, there is generated a tip leakage vortex W of fluid flowing from the pressure side of a full blade 5 on the upstream side in the rotating direction (front side full blade 5F) to the suction side of the full blade 5 through a clearance between the tip of the leading edge 5*a* (shroud side) of the full blade 5 and the shroud.

Figure 8:
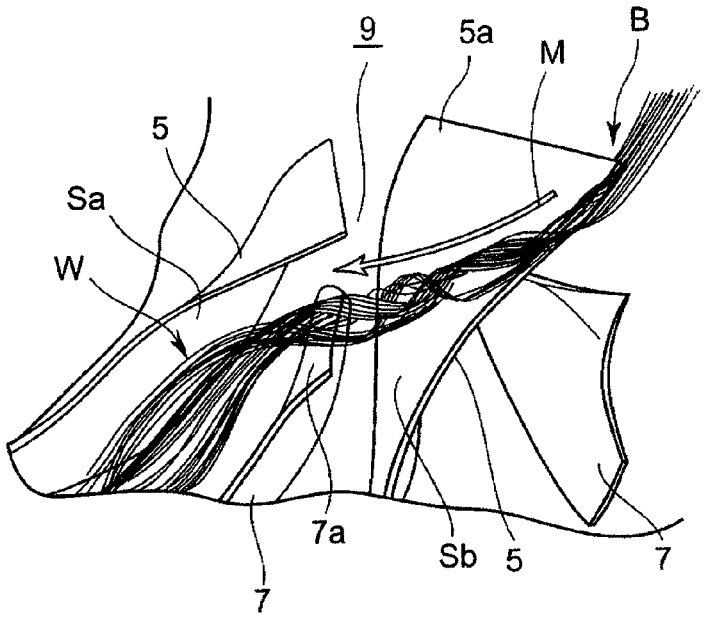
FIG. 8 shows results of a numerical analysis showing a tip leakage flow flowing from the tip of the full blade and formed at the tip of the splitter blade at the inlet end.
Figure 9:
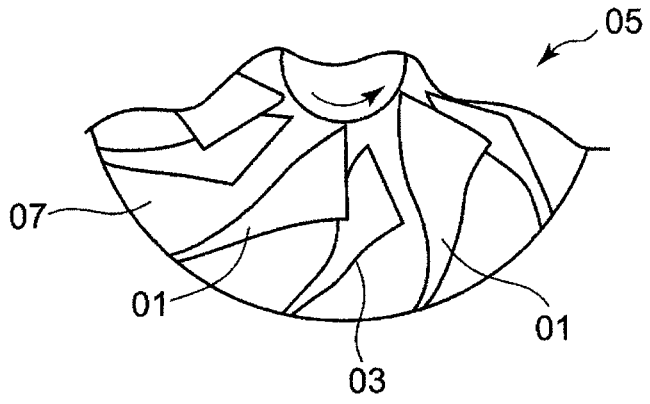
FIG. 9 is a diagram for explaining a conventional technique.
Figure 10:
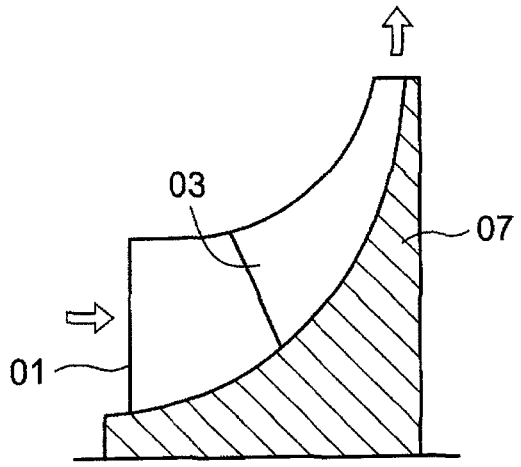
FIG. 10 is a diagram for explaining a conventional technique.
Figure 11:
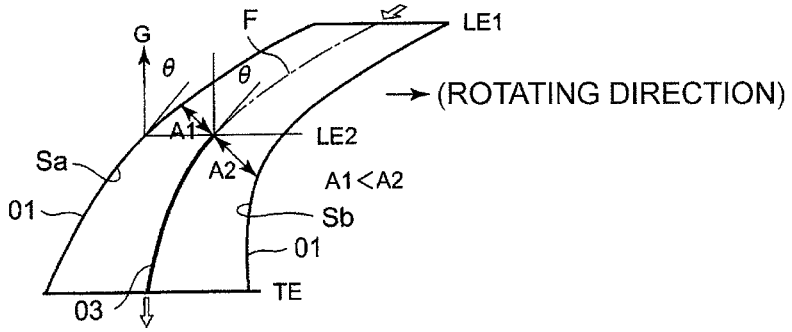
FIG. 11 is a diagram for explaining a conventional technique.
Figure 12:
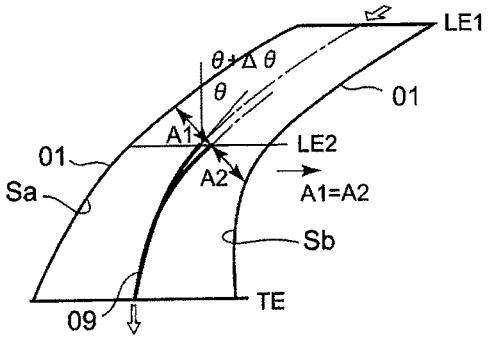
FIG. 12 is a diagram for explaining a conventional technique.

This tip leakage vortex W affects the flow in the vicinity of the leading edge 7*a* of the first splitter blade 7. A numerical analysis was thus made as to the conditions of this tip leakage vortex W. FIG. 8 shows a streamline diagram drawn from the results of this numerical analysis (FIG. 8 illustrates only the relation with the first splitter blade 7).

This tip leakage vortex W involves a strong swirling flow and causes a high blocking effect on the flow along the full blade 5. As a consequence, the fluid does not flow along the full blade 5 near the leading edge 7*a* of the first splitter blade 7, and there is created a drift flow M that flows spirally around the swirl toward the leading edge of the splitter blade 7.

The leading edge 7*a* on the shroud side of the first splitter blade 7 is offset from the circumferentially trisected position between the full blades 5 toward the suction side Sb of the full blade 5, so that the direction of this tip leakage vortex W, although it may vary depending on the running condition of the compressor, will be such that the fluid flows over the leading edge 7*a* on the shroud side of the first splitter blade 7, or such that the leading edge 7*a* substantially faces (conforms to) the flow at the peak efficiency point.

Here, the direction of the tip leakage vortex W at the peak efficiency point is used as the reference direction so as to cover a wide range of operating conditions.

"To substantially face (conform to)" means that the inclination angle β of the leading edge 7*a* on the shroud side of the first splitter blade 7 is substantially the same as that of the flow direction of the tip leakage vortex, so that the spiral flow does not interfere (intersect) with the leading edge 7*a* on the shroud side of the first splitter blade 7.

The first splitter blade 7 is located at a circumferentially trisected position between a front side full blade 5F and a rear side full blade 5R, and its leading edge 7*a* is likewise located at a circumferentially trisected position between the front side full blade 5F and the rear side full blade 5R.

The position of the leading edge 7*a* of the first splitter blade 7, i.e., its position in the length direction, can be set by various techniques.

For example, it may be set at an intersection between a line Z1 indicating the direction of the tip leakage vortex W at the peak efficiency point, which may be determined by a numerical analysis or through tests using actual machines, and a trisected position between the front and rear full blades 5F and 5R, as shown in FIG. 2.

Alternatively, it may be set at an intersection between a line Z1 determined as indicating the direction of the tip leakage vortex and a trisected position between the front and rear full blades 5F and 5R, the line Z1 being drawn by connecting a center position of the so-called throat where the distance from the leading edge 5*a* of the rear side full blade 5R to the suction side Sb of the front side full blade 5F arranged adjacent the rear side full blade 5R on the front side in the rotating direction is minimum, and the leading edge 5*a* of the front side full blade 5F.

In either method, it is set at an intersection between a line Z1 that indicates the direction of the tip leakage vortex W determined as a reference, and a trisected position between the front and rear full blades 5F and 5R.

The leading edge 7*a* of the splitter blade 7, whose position is set as a reference as described above, is inclined on the shroud side, as shown in FIG. 2A and FIG. 2C, to be offset toward the suction side Sb of the front side full blade 5F. The splitter blade is inclined so that it is more skewed (slanted) than the front side full blade 5F or the rear side full blade 5R standing on the hub 3, as shown in FIG. 2C. The trailing edge 7*b* on the shroud side is located at the circumferentially equally spaced position.

The offset amount Δθ1 (see FIG. 2A and FIG. 2C) of the first splitter blade 7 toward the suction side Sb of the front side full blade 5F may be about 10%, preferably 10% or more, of the distance between the front and rear first splitter blades 7. The offsetting (Δθ1) may be started at a point X about 0.1 to 0.3 of the axial length L of the full blade 5 from the tip.

These ranges of offset amount Δθ1 and starting point were determined effective to avoid interference between the tip leakage vortex and the leading edge 7*a* of the first splitter blade 7 over a wide range of operating conditions of the compressor from a low load operating point to a high load operating point based on results of simulations and numerical studies, and confirmation results of tests conducted with actual machines.

On the other hand, the leading edge 7*a* and the trailing edge 7*b* of the first splitter blade 7 on the hub side are located at the circumferentially equally spaced position as shown in FIG. 2B and FIG. 2D.

The position of the second splitter blade 8 is set also based on a relationship similar to that between the first splitter blade 7 and the front side full blade 5F.

Namely, it is set at an intersection between a line Z2 that indicates the direction of the tip leakage vortex W coming from the leading edge 7*a* of the first splitter blade 7 determined as a reference, and a trisected position between the front and rear full blades 5F and 5R.

The leading edge 8*a* of the second splitter blade 8, whose position is set as a reference as described above, is inclined on the shroud side, as shown in FIG. 2A and FIG. 2C, to be offset toward the suction side Sb of the front side full blade 5F. The splitter blade is inclined so that it is more skewed (slanted) than the front side full blade 5F or the rear side full blade 5R standing on the hub 3, as shown in FIG. 2C. The trailing edge 8*b* on the shroud side is located at the circumferentially equally spaced position.

The offset amount Δθ2 (see FIG. 2A and FIG. 2C) of the second splitter blade 8 toward the suction side of the first splitter blade 7 is set larger than the offset amount Δθ1 of the first splitter blades 7.

This is because the tip leakage vortex that flows toward the leading edge portion 8*a* on the shroud side of the second splitter blade 8 is generated at the leading edge 7*a* of the first splitter blade 7, and therefore the offset amount needs to be larger than the offset amount Δθ1 of the leading edge portion 7*a* of the first splitter blade 7.

Moreover, since the tip leakage vortex that flows toward the leading edge portion 8*a* on the shroud side of the second splitter blade 8 contains both the tip leakage vortex formed by the front side full blade 5F and the tip leakage vortex formed by the first splitter blade 7, the offset amount Δθ2 of the second splitter blade 8 toward the first splitter blade 7 needs to be set larger than the offset amount Δθ1 of the first splitter blade 7 toward the suction side Sb of the front side full blade 5F to avoid the tip leakage vortex effectively. Thereby the tip leakage vortex can be veered away from the second splitter blade 8 reliably.

Moreover, as the first splitter blades 7 and the second splitter blades 8 arranged between the full blades 5 are inclined, the respective blades are spaced at unequal intervals in the circumferential direction, whereby an effect of reducing compressor noise due to a relationship between the rotation number of the centrifugal compressor and the number of blades can be achieved.

Figure 7:
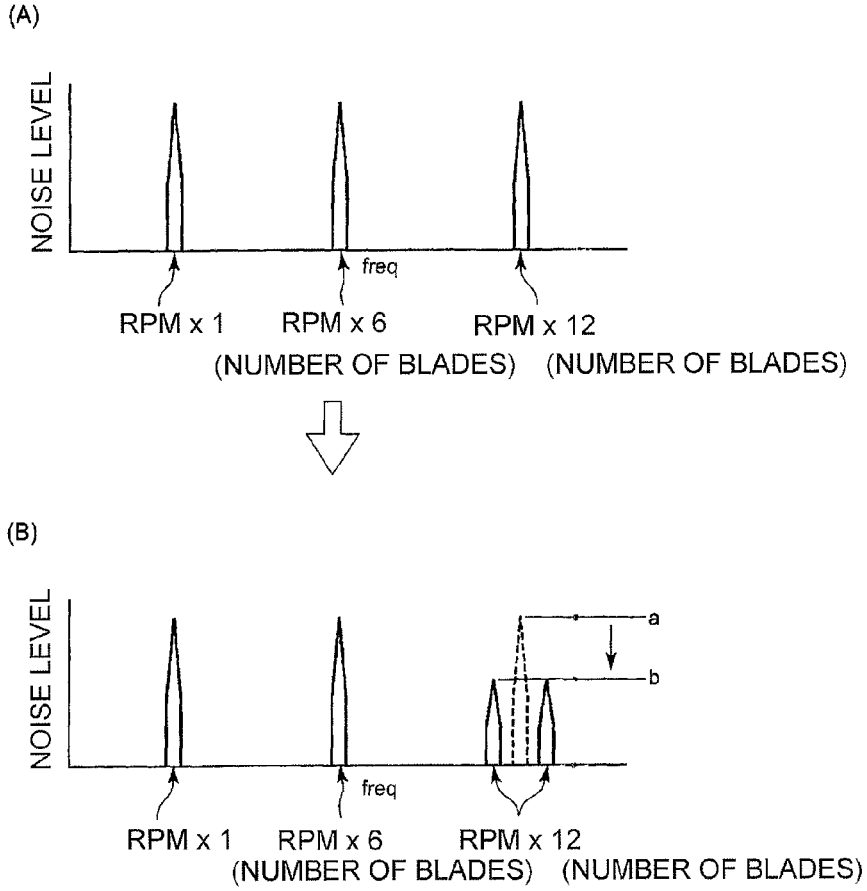
FIG. 7 is an explanatory diagram illustrating a relation between the number of blades and compressor noise.

FIG. 7 is a graph showing noise peak values on the vertical axis and resonant frequencies on the horizontal axis. For example, when the circumferential position of the splitter blade is shifted by 10% toward the suction side, the splitter blade-to-blade space is reduced by 20% from the conventional 50% to 40% on one side so that the frequency is increased by 20%. The space is increased by 20% on the other side from the conventional 50% to 60% so that the frequency is decreased by 20%. As a result, the peak value is reduced from a to b (see FIG. 7(B)) by the phase offset.

(Second Embodiment)

Next, a second embodiment will be described with reference to FIG. 3A to FIG. 3D. In the second embodiment, in comparison to the first embodiment, the trailing edge 7*b* of the first splitter blade 7 is offset toward the suction side Sb of the front side full blade 5F, and the trailing edge 8*b* of the second splitter blade 8 is offset toward the first splitter blade 7.

Figure 3C:
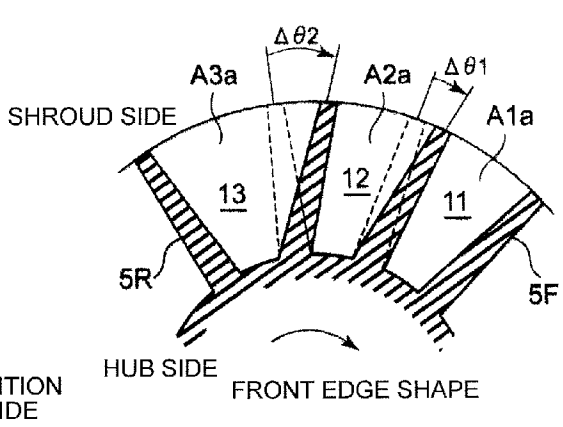
FIG. 3 is an explanatory diagram illustrating the relationship between the full blades and splitter blades in a second embodiment, FIG. 3A showing the positional relationship on the shroud side in the circumferential direction, FIG. 3B showing the positional relationship on the hub side in the circumferential direction, FIG. 3C showing a front view of a leading edge shape relative to a flow direction, and FIG. 3D showing a front view of a trailing edge shape relative to the flow direction.
Figure 3D:
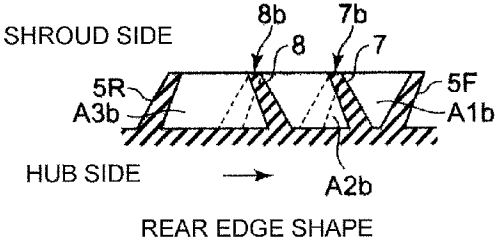

As the trailing edge 7*b* of the first splitter blade 7 is offset toward the suction side Sb of the front side full blade 5F, and the trailing edge 8*b* of the second splitter blade 8 is offset toward the first splitter blade 7, the trailing edge 7*b* of the first splitter blade 7 and the trailing edge 8*b* of the second splitter blade 8 are more upright than the front side full blade 5F or the rear side full blade 5R relative to the hub 3, as shown in FIG. 3D.

As the trailing edge 7*b* of the first splitter blade 7 is offset toward the suction side Sb of the front side full blade 5F, and the trailing edge 8*b* of the second splitter blade 8 is offset toward the first splitter blade 7 in this way, an even balance of blade load between the hub side and the shroud side is achieved in respective splitter blades 7 and 8, and the pressure ratio can be increased.

The blade load balance will be explained.

In the first embodiment, as shown in FIG. 2A, the leading edge 7*a* on the shroud side of the first splitter blade 7 is offset toward the suction side Sb of the front side full blade 5F, and the leading edge 8*a* on the shroud side of the second splitter blade 8 is offset toward the first splitter blade 7, so as to avoid interference with the tip leakage vortex at the leading edges 7*a* and 8*a* on the shroud side of the respective splitter blades 7 and 8.

The leading edges 7*a* and 8*a* on the shroud side of the respective splitter blades 7 and 8, however, have a larger blade curvature (higher blade load) due to the inclination toward upstream in the rotating direction.

Correspondingly, the hub side is also offset toward the suction side Sb of the front side full blade 5F to increase the blade curvature (blade load).

The blade load on the hub side is thus increased corresponding to the increase in blade load on the shroud side, so as to achieve an even balance of blade load between the hub side and the shroud side of the respective splitter blades 7 and 8.

Figure 3A:
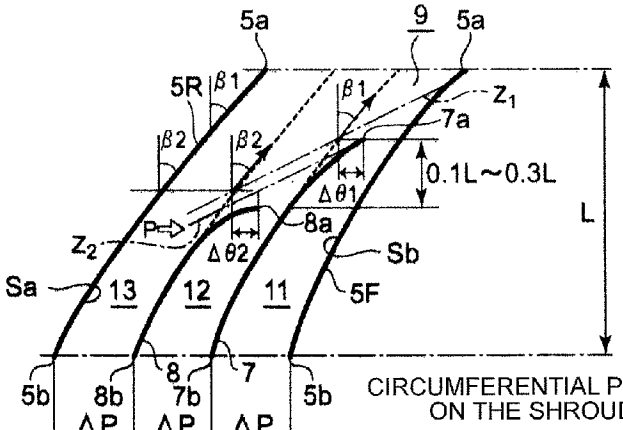
Figure 3B:
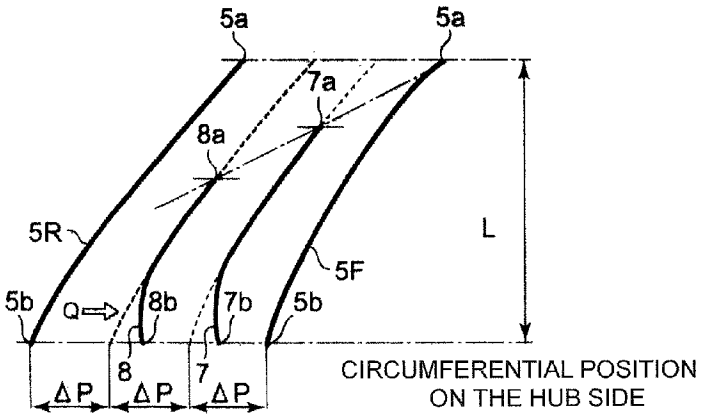

The splitter blade is offset in the direction of arrow P in FIG. 3A on the shroud side, and in the direction of arrow Q in FIG. 3B on the hub side, so as to achieve an even balance of blade load between the hub side and the shroud side of the respective splitter blades 7 and 8, as well as to increase the blade curvature of the splitter blade as a whole, to increase the blade load.

As a result, the risk of separation or the like is reduced, as the blade load is lowered on the shroud side, while the pressure ratio of the compressor as a whole can be increased due to the increased load on the hub side. Furthermore, as the imbalance of load applied to the respective splitter blades 7 and 8 is eliminated, the durability of the impeller 1 can be improved.

In this embodiment, in order to avoid interference with the tip leakage vortex, as described above, the leading edge 7*a* on the shroud side of the first splitter blade 7 and the leading edge 8*a* on the shroud side of the second splitter blade 8 are offset, and in addition, the trailing edges 7*b* and 8*b* on the hub side of the respective splitter blades 7 and 8 are offset in order to achieve an even balance of blade load applied to the respective splitter blades 7 and 8.

Further in addition to this, the passage area ratios may be made uniform as described below. That is, the offset amounts $\Delta\theta 1$ and $\Delta\theta 2$ of the leading edges 7*a* and 8*a* on the shroud side of the respective splitter blades 7 and 8 and the offset amount of the trailing edges 7*b* and 8*b* on the hub side of the splitter blades 7 and 8 may be set such that the ratios of areas at the inlet and outlet of the respective passages 11, 12, and 13 divided by the splitter blades 7 and 8 are uniform.

The ratio of areas A1*a*/A1*b* between the inlet area A1*a* and the outlet area A1*b* of the passage 11, the ratio of areas A2*a*/A2*b* between the inlet area A2*a* and the outlet area A2*b* of the passage 12, and the ratio of areas A3*a*/A3*b* between the inlet area A3*a* and the outlet area A3*b* of the passage 13 are set equal to each other.

The inlet area and the outlet area refer to areas of cross sections cut in a direction orthogonal to the flow passage.

By making the ratios of areas at the inlet and the outlet uniform in this manner, there will hardly be a pressure difference between the passages 11, 12, and 13 divided respectively by the first and second splitter blades 7 and 8, which will prevent the fluid from leaking and flowing over the first and second splitter blades 7 and 8, whereby a drop in the compressor performance can be prevented, and also, the improved efficiency can lead to an increase in the operation range.

(Third Embodiment)

Figures 4A, 4B, 4C, 4D:
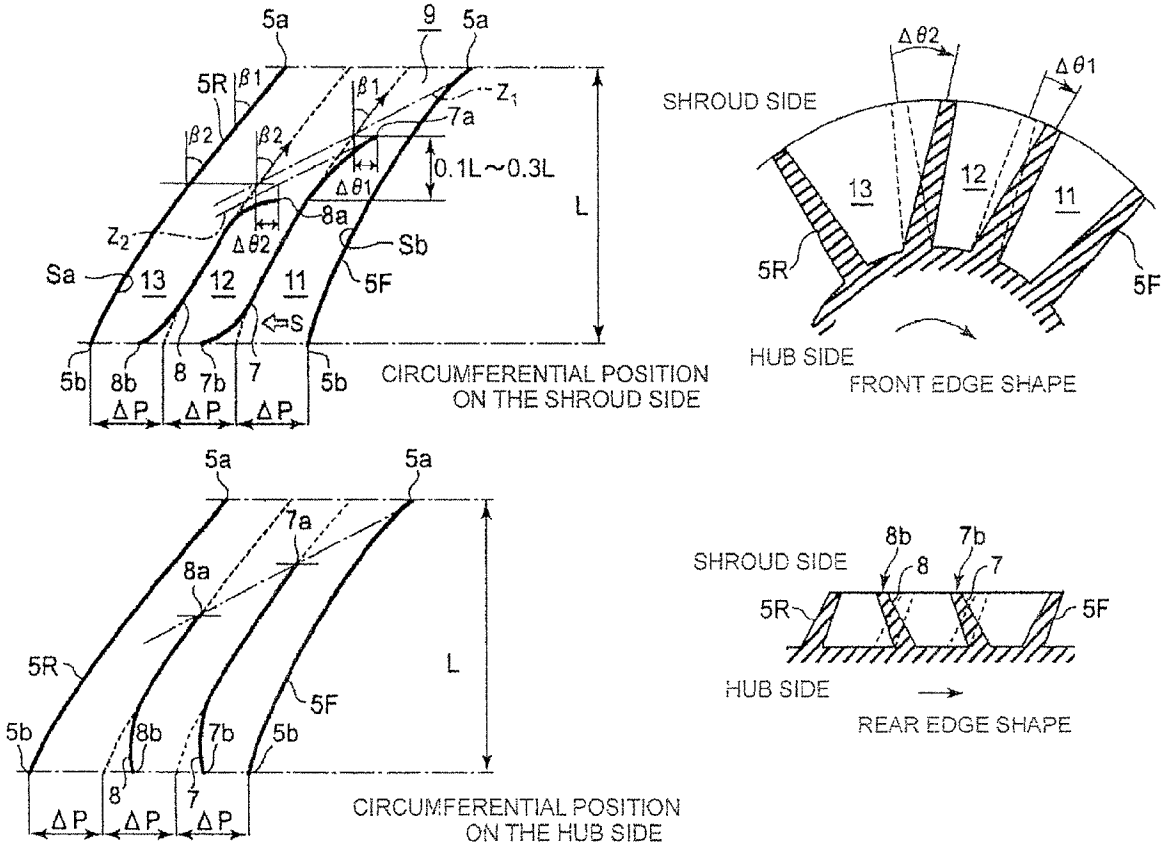
FIG. 4 is an explanatory diagram illustrating the relationship between the full blades and splitter blades in a third embodiment, FIG. 4A showing the positional relationship on the shroud side in the circumferential direction, FIG. 4B showing the positional relationship on the hub side in the circumferential direction, FIG. 4C showing a front view of a leading edge shape relative to a flow direction, and FIG. 4D showing a front view of a trailing edge shape relative to the flow direction.

Next, a third embodiment will be described with reference to FIG. 4.

The third embodiment is characterized in that, in addition to the features of the second embodiment, the trailing edge 7*b* on the shroud side of the first splitter blade 7 is offset toward the second splitter blade 8, and the trailing edge 8*b* on the shroud side of the second splitter blade 8 is offset toward the pressure side Sa of the rear side full blade 5R.

In the second embodiment described above, the trailing edges 7*b* and 8*b* on the hub side of the first and second splitter blades 7 and 8 are offset toward upstream (front side) in the rotating direction in order to achieve an even balance of blade load applied to the first and second splitter blades 7 and 8.

However, the load on the shroud side may not be counterbalanced by offsetting the trailing edges 7*b* and 8*b* on the hub side toward upstream (front side) in the rotating direction, and there may still be the risk of separation or the like occurring on the shroud side. For such a case, in the third embodiment, to further counterbalance the blade load on the shroud side, the trailing edge 7*b* on the shroud side of the first splitter blade 7 is offset toward the second splitter blade 8, and the trailing edge 8*b* on the shroud side of the second splitter blade 8 is offset toward the pressure side Sa of the rear side full blade 5 in the direction of arrow S in FIG. 4A, to reduce the blade curvature (blade load) on the shroud side of the respective splitter blades 7 and 8.

Thereby, the load on the shroud side can be reduced even more effectively than the second embodiment, and the blade load can be made even between the hub side and the shroud side of the respective splitter blades 7 and 8.

The ratios of areas at the inlet and the outlet may be made uniform, with the same advantageous effects as those of the first embodiment.

(Fourth Embodiment)

Next, a fourth embodiment will be described with reference to FIG. 5. In the first to third embodiments, the compressor was described as having two splitter blades, but it may have three or more splitter blades. In the fourth embodiment, a compressor with three splitter blades will be described.

Figure 5:
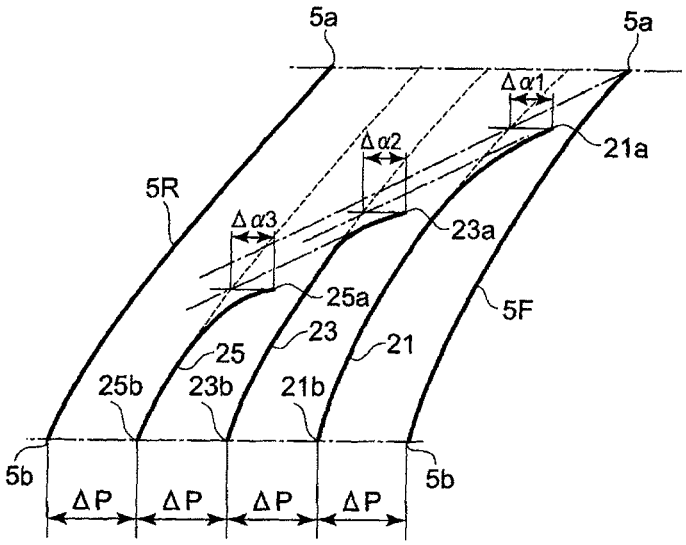
FIG. 5 shows the positional relationship between the full blades and splitter blades on the shroud side in the circumferential direction in a fourth embodiment.

As shown in FIG. 5, a first splitter blade 21, a second splitter blade 23, and a third splitter blade 25 are located at three equally spaced positions between the front and rear full blades 5F and 5R.

The splitter blades are progressively shorter in the order of the first splitter blade 21, the second splitter blade 23, and the third splitter blade 25.

The leading edge 21*a* on the shroud side of the first splitter blade 21 is offset by an amount $\Delta\alpha 1$ to avoid interference with the tip leakage vortex coming from the leading edge 5*a* of the front side full blade 5F. The leading edge 23*a* on the shroud side of the second splitter blade 23 is offset by an amount $\Delta\alpha 2$ to avoid interference with the tip leakage vortex coming from the leading edge 21*a* of the first splitter blade 21. The leading edge 25*a* on the shroud side of the third splitter blade 25 is offset by an amount $\Delta\alpha 3$ to avoid interference with the tip leakage vortex coming from the leading edge 23*a* of the second splitter blade 23. These offset amounts have a relationship of $\Delta\alpha 1<\Delta\alpha 2<\Delta+3$.

These offset amounts are set to have this relationship because, as mentioned above, the tip leakage vortex that flows toward the leading edge portion 23*a* on the shroud side of the second splitter blade 23 is generated at the leading edge 21*a* of the first splitter blade 21*a*, and therefore the offset amount needs to be larger than the offset amount $\Delta\alpha 1$ of the leading edge portion 21*a* of the first splitter blade 21, and that the same applies to the third splitter blade 25.

Moreover, since the tip leakage vortex that flows toward the leading edge portion 23*a* on the shroud side of the second splitter blade 23 contains both the tip leakage vortex formed by the front side full blade 5F and the tip leakage vortex formed by the first splitter blade, the offset amount $\Delta\alpha 2$ of the second splitter blade 23 toward the first splitter blade 21 needs to be set larger than the offset amount $\Delta\alpha 1$ of the first splitter blade 21 toward the suction side Sb of the front side full blade 5F to avoid the tip leakage vortex effectively.

Other advantageous effects are the same as those of the compressor with two splitter blades described in the first to third embodiments.

(Fifth Embodiment)

Next, a fifth embodiment will be described with reference to FIG. 6. In the fifth embodiment, a compressor having a different layout pattern of three splitter blades from that of the fourth embodiment will be described.

Figure 6:
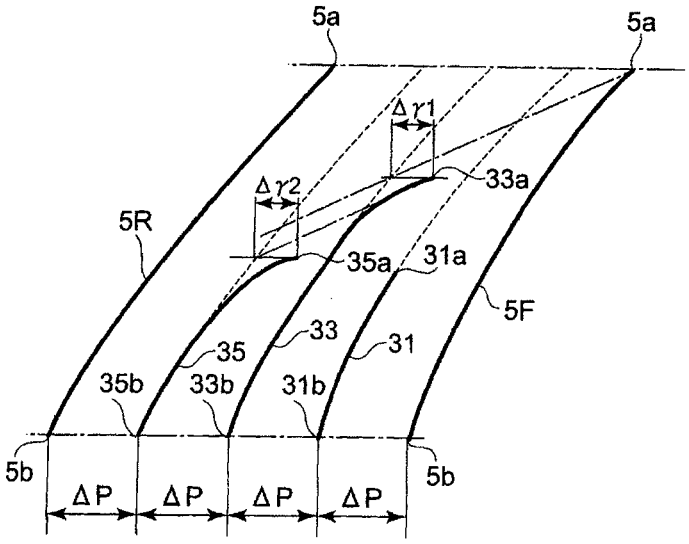
FIG. 6 shows the positional relationship between the full blades and splitter blades on the shroud side in the circumferential direction in a fifth embodiment.

As shown in FIG. 6, a first splitter blade 31, a second splitter blade 33, and a third splitter blade 35 are located at three equally spaced positions between the front and rear full blades 5F and 5R.

The first splitter blade 31 is the shortest, and the third splitter blade 35 is shorter than the second splitter blade 33.

In this case, the front side full blade 5F and the second and third splitter blades 33 and 35 are in the same relationship in respect of the tip leakage vortex as that of the previously described first embodiment.

The tip leakage vortex that flows toward the leading edge 33*a* on the shroud side of the second splitter blade 33 is generated at the leading edge 5*a* of the front side full blade 5F, and the tip leakage vortex that flows toward the leading edge 35*a* on the shroud side of the third splitter blade 35 is generated at the leading edge 33*a* on the shroud side of the second splitter blade 33.

Therefore, the offset amount $\Delta\gamma 2$ of the leading edge 35*a* of the third splitter blade 35 should preferably be set larger than the offset amount $\Delta\gamma 1$ of the second splitter blade 33.

The first splitter blade 31, as it is not affected by the tip leakage vortex, is located at one of the three equally spaced positions between the front and rear full blades 5F and 5R as it would commonly be, with its leading edge 31*a* not being offset.

Same advantageous effects as those of the compressor with two splitter blades described in the first to third embodiments can be achieved.

INDUSTRIAL APPLICABILITY

According to the present invention, in a centrifugal compressor having two or more splitter blades between the full blades, the tip leakage vortex of the full blades and splitter blades is prevented from interfering with the plurality of splitter blades located downstream in the rotating direction, whereby the pressure ratio and efficiency can be increased, and therefore the invention can suitably be applied to centrifugal compressors.

The invention claimed is:

1. A centrifugal compressor impeller, comprising:

a plurality of full blades standing equally spaced in a circumferential direction and extending from a fluid inlet part to a fluid outlet part on a surface of a hub; and two or more splitter blades each provided to extend from a point in a flow passage formed between the full blades arranged adjacent to each other, to the outlet part, wherein the two or more splitter blades at least include a first splitter blade provided on a side nearer to a suction side of a full blade located upstream in a rotating direction of the compressor and having a length in a flow passage direction shorter than that of the upstream side full blade; and a second splitter blade provided on a suction side of the first splitter blade and having a length in the flow passage direction shorter than that of the first splitter blade, wherein leading edge portions on a shroud side of the first splitter blade and the second splitter blade are offset toward the suction side of the full blade from positions dividing a space between the full blades at equal intervals by the number of splitter blades therebetween, and wherein an offset amount of the leading edge portion at the shroud side of the second splitter blade, from a position at which the space between the full blades is divided by the second splitter blade to a position of the leading edge portion of the second splitter blade, is larger than an offset amount of the leading edge portion at the shroud side of the first splitter blade, from a position at which the space between the full blades is divided by the first splitter blade to a position of the leading edge portion of the first splitter blade.

2. The centrifugal compressor impeller according to claim 1, wherein respective trailing edge portions on the hub side of the first splitter blade and the second splitter blade are offset toward the suction side of the full blade from positions dividing a space between the full blades at equal intervals by the number of splitter blades therebetween.

3. The centrifugal compressor impeller according to claim 2, wherein respective trailing edge portions on the shroud side of the first splitter blade and the second splitter blade are offset toward a pressure side of the full blade from positions dividing a space between the full blades at equal intervals by the number of splitter blades therebetween.

4. The centrifugal compressor impeller according to claim 1, further comprising a third splitter blade provided on a suction side of the second splitter blade and having a length in the flow passage direction shorter than that of the second splitter blade, wherein a leading edge portion on a shroud side of the third splitter blade is offset toward the suction side of the full blade from one of the positions dividing the space between the full blades at equal intervals by the number of splitter blades therebetween.

5. The centrifugal compressor according to claim 4, wherein an offset amount of the leading edge portion at the shroud side of the third splitter blade from a position at which the space between the full blades is divided by the third splitter blade to a position of the leading edge portion of the third splitter blade, is larger than the offset amount of the leading edge portion at the shroud side of the second splitter blade.

6. The centrifugal compressor according to claim 4, wherein an offset amount of the leading edge portion at the shroud side of the third splitter blade, from a position at which the space between the full blades is divided by the third splitter blade to a position of the leading edge portion of the third splitter blade, is larger than an offset amount of the leading edge portion at the shroud side of the second splitter blade.

7. The centrifugal compressor impeller according to claim 1, further comprising a third splitter blade provided on a suction side of the second splitter blade and having a length in the flow passage direction shorter than that of the second splitter blade, wherein a leading edge portion on a shroud side of the third splitter blade is offset toward the suction side of the full blade from one of the positions dividing the space between the full blades at equal intervals by the number of splitter blades therebetween.

* * * * *